United States Patent [19]

Takaoka et al.

[11] Patent Number: 5,045,879

[45] Date of Patent: Sep. 3, 1991

[54] IMAGE FORMING APPARATUS USING PHOTOSENSITIVE TONER

[75] Inventors: Kazuhito Takaoka, Kadoma; Kazushige Inoue, Takatsuki; Masatoshi Uehara, Hirakata; Yumiko Sano, Osaka, all of Japan

[73] Assignee: Mita Industrial Co., Ltd., Osaka, Japan

[21] Appl. No.: 580,038

[22] Filed: Sep. 10, 1990

[30] Foreign Application Priority Data

Sep. 29, 1989 [JP] Japan ..... 1-256799

[51] Int. Cl.[5] ..... G03G 15/00

[52] U.S. Cl. ..... 355/200; 355/269

[58] Field of Search ..... 355/200, 267–270, 355/296, 298; 430/31, 37

[56] References Cited

U.S. PATENT DOCUMENTS 4,129,072 12/1978 Fujii et al. ..... 355/269 X 4,634,646 1/1987 Sano et al. ..... 430/31

FOREIGN PATENT DOCUMENTS 60-165674 8/1985 Japan ..... 355/269

*Primary Examiner*—Joan H. Pendegrass

*Attorney, Agent, or Firm*—Armstrong, Nikaido, Marmelstein, Kubovcik & Murray

[57] ABSTRACT

Disclosed is an image forming apparatus in which photosensitive toner remaining on an electrically-conductive drum after the formation of an image is collected and then used again for the subsequent process of forming an image. The apparatus comprises a toner storage unit including a toner feed system and a toner collecting system both disposed within a single housing. The toner feed system feeds toner onto an electrically-conductive drum for the formation of an image. The toner collecting system includes a blade for removing the toner remaining on the conductive drum after the formation of the image, and also includes a transporting paddle or a feeder for delivering the removed toner back to the toner feed system, the toner then being supplied again onto the electrically-conductive drum for the subsequent image-forming process.

6 Claims, 2 Drawing Sheets

IMAGE FORMING APPARATUS USING PHOTOSENSITIVE TONER

BACKGROUND OF THE INVENTION

1. Field of the invention

The present invention relates to an image forming apparatus which forms an image by use of a photosensitive toner.

2. Description of the prior art

In an image forming apparatus, electrophotography or electrostatic printing is generally used for the formation of images. Electrophotography utilizes an image-bearing member in the form of a drum or a belt which is coated with a photoconductive layer, while electrostatic printing utilizes an image-bearing member in the form of a drum or a belt which is coated with a dielectric layer. In either case, as the image-bearing member rotates, an electrostatic latent image is first formed on the image-bearing member and then developed with a dry developer (i.e., toner) into a toner image. The toner image thus formed on the image-bearing member is then transferred onto a sheet of copy paper, resulting in a final image thereon.

In such an image forming apparatus, around the image-bearing member in the form of a drum or a belt, a charging means, an exposure means, a developing means, a transfer means and a cleaning means are disposed in that order in the direction of the rotation of the image-bearing member. Since it is desirable to make the image forming apparatus as small as possible, each means disposed in the apparatus is also required to be smaller in size.

After the formation of an image, toner remaining on the image-bearing member is removed by the cleaning means. In general, the used toner removed by the cleaning means is delivered into a used toner container to be stored therein. Another type of image forming apparatus has been proposed in which the used toner removed by the cleaning means is fed back to the developing means and used again for the subsequent image forming processes. Such an image forming apparatus can be reduced in size to some degree because it does not require the used toner container, and furthermore, the reuse of the toner decreases the operating cost of the apparatus.

However, the size of an image forming apparatus of the above-mentioned type cannot be sufficiently reduced for the following reason: Between the developing means and the cleaning means, the charging means, the transfer means, and the like, are located. Thus, the developing means and the cleaning means cannot be formed as a single unit, so that a separate transporting system is required for transporting the used toner from the cleaning means into the developing means. Since such a used toner-transporting system should be mounted in the image forming apparatus, the whole apparatus cannot be sufficiently reduced in size.

Another image forming apparatus has been developed in which a magnetic brush or a fur brush functioning as a developing means for supplying toner onto the image-bearing member also functions as a cleaning means for removing the used toner from the image-bearing member. In such an apparatus, the magnetic brush or the fur brush first supplies toner onto the electrostatic latent image on the image-bearing member to develop it into a toner image, which is then transferred onto a copy sheet. Thereafter, the toner remaining on the image-bearing member is removed by the magnetic brush or the fur brush. Such an image forming apparatus does not require a separate cleaning means or a used toner-transporting system, so that the apparatus can be greatly reduced in size. However, since the developing means (magnetic brush or fur brush) also functions as the cleaning means, the development of the latent image on the image-bearing member cannot be simultaneously performed with the cleaning of the image-bearing member. For example, with the image-bearing member in the form of a drum, the development of the latent image is performed as the image-bearing member completes its first revolution, and then the image-bearing member is cleaned of the remaining toner during its second revolution. Thus, the image-forming processes cannot be continuously performed, so that the copy speed is reduced.

Still another image forming apparatus has been developed in which a blade which can move to, and away from, the image-bearing member is located upstream (viewed from the rotation of the image-bearing member) of the developing means. In this type of image forming apparatus, the blade is kept away from the image-bearing member during the process of developing the latent image thereon, while the blade is kept in contact with the image-bearing member during the process of cleaning it of the remaining toner. Thus, also in this image forming apparatus, the developing and cleaning processes cannot be performed simultaneously. Thus, the image-forming processes cannot be continuously performed, resulting in a reduced copy speed. Furthermore, in such an apparatus, the blade must be accurately controlled to move toward, and away from, the image-bearing member in synchronization with the rotation of the image-bearing member. Thus, the apparatus requires a complicated system for controlling the movement of the blade. The apparatus is also disadvantageous in that the image-bearing member tends to be damaged by the blade because the blade repeatedly moves to, and away from, the image-bearing member. This deteriorates the quality of the resultant image.

SUMMARY OF THE INVENTION

The image forming apparatus of this invention, which overcomes the above-discussed and numerous other disadvantages and deficiencies of the prior art, comprises: an electrically-conductive drum which rotates in a predetermined direction; a toner storage means facing said electrically-conductive drum and having a housing which contains a photosensitive toner electrically charged in a prescribed polarity, said toner storage means including a toner feed system mounted in said housing for feeding said photosensitive toner onto said rotating electrically-conductive drum, thereby forming a thin toner layer thereon; an exposure means located downstream in the rotation of said electrically-conductive drum with respect to said toner storage means, said exposure means selectively illuminating said thin toner layer so as to selectively electrically discharge said photosensitive toner of said thin toner layer, thereby forming an electrostatic latent image in said thin toner layer; and a transfer means located downstream in the rotation of said electrically-conductive drum with respect to said exposure means, said transfer means selectively transferring the photosensitive toner of said electrostatic latent image onto a copy sheet, thereby forming a final image thereon; wherein said toner storage means further includes a toner collecting system mounted in said housing and positioned upstream in the rotation of said electrically-conductive drum with respect to said toner feed system, said toner collecting system removing the photosensitive toner remaining on said electrically-conductive drum after the formation of said toner image, so as to collect the removed photosensitive toner into said housing, and thereafter delivering the collected photosensitive toner into said toner feed system.

In a preferred embodiment, the toner collecting system comprises a blade which slides along the electrically-conductive drum to remove the photosensitive toner remaining thereon after the formation of the toner image, thereby collecting the photosensitive toner into the housing, the toner collecting system also comprising a transporting paddle for delivering the thus collected photosensitive toner into the toner feed system.

In another preferred embodiment, the toner collecting system comprises a blade which slides along the electrically-conductive drum to remove the photosensitive toner remaining thereon after the formation of the toner image, the toner collecting system also comprising a hopper for storing the photosensitive toner removed by said blade, and a feeder for supplying the photosensitive toner stored in the hopper into the toner feed system.

In a preferred embodiment, the photosensitive toner is mixed with a magnetic carrier to be electrically charged through friction therebetween.

In a preferred embodiment, the toner feed system includes an electrically-conductive sleeve, part of which protrudes from the housing to face the electrically-conductive drum, the electrically-conductive sleeve containing a magnet therein to enable the formation of a magnetic brush on the circumferential surface thereof, the toner feed system also including a stirring paddle for feeding the photosensitive toner contained in the housing onto the electrically-conductive sleeve.

In a preferred embodiment, the toner feed system includes an electrically-conductive sleeve which rotates to carry the photosensitive toner on the circumferential surface thereof, and a metal blade which slides along said electrically-conductive sleeve to rub against said photosensitive toner carried thereon, thereby electrically charging said photosensitive toner.

In the image forming apparatus of the present invention, the photosensitive toner in the housing of the toner storage means is electrically charged in a prescribed polarity, and then delivered by the toner feed system onto the electrically-conductive drum so that a thin toner layer is formed thereon. While the electrically-conductive drum makes one revolution, the following processes are performed: The toner layer on the electrically-conductive drum is selectively irradiated with light emitted from the exposure means so that the photosensitive toner is selectively discharged electrically, resulting in an electrostatic latent image consisting of the charged toner and the thus discharged toner in the toner layer on the electrically-conductive drum. Then, the electrostatic latent image is conveyed to the position facing the transfer means, where only the discharged photosensitive toner in the latent image is transferred to a copy sheet, resulting in a final image thereon. After this transfer process is completed, the photosensitive toner remaining on the electrically-conductive drum comes to the position facing the toner storage means. The remaining toner on the conductive drum is removed by the toner collecting system of the toner storage means, the removed toner then falling into the housing of the toner storage means. The thus collected toner is then delivered back to the toner feed system, from which it is fed again onto the electrically-conductive drum to form a new toner layer thereon. By the time when the conductive drum completes one revolution, this cleaning process is completed.

As described above, in the image forming apparatus of the present invention, since the toner feed system and the toner collecting system are both placed in a single housing, the whole apparatus can be reduced in size. Furthermore, as the conductive drum makes one revolution, the image formation and the cleaning of the drum are completed, so that images can be continuously formed, resulting in a high copy speed.

BRIEF DESCRIPTION OF THE DRAWINGS

This invention may be better understood and its numerous objects and advantages will become apparent to those skilled in the art by reference to the accompanying drawings as follows.

DESCRIPTION OF THE PREFERRED EMBODIMENTS

EXAMPLE 1

Figure 1:
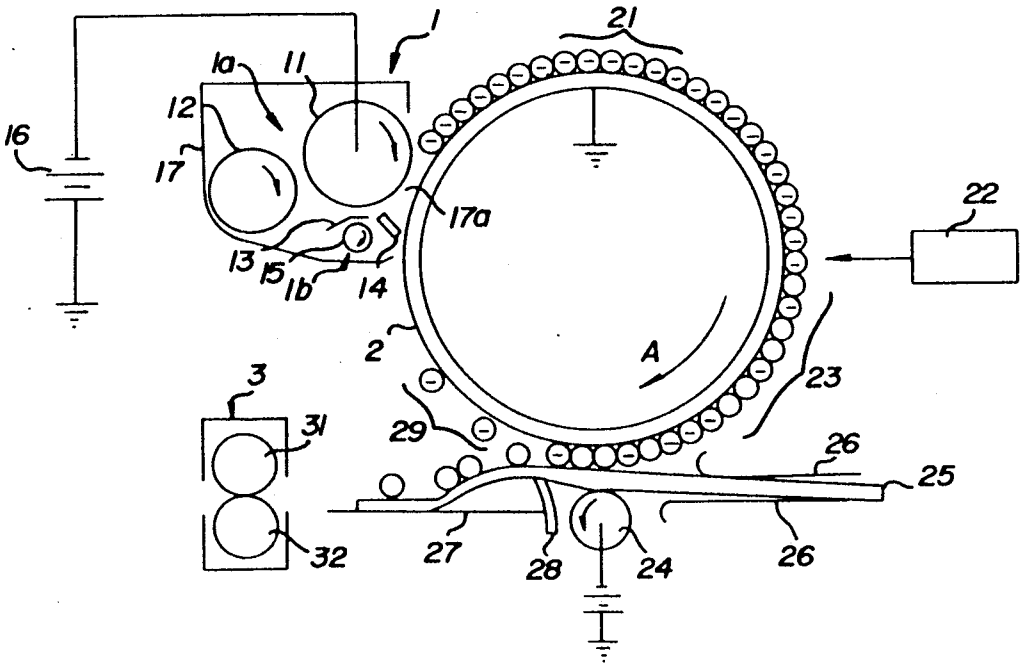
FIG. 1 is a schematic diagram showing an image forming apparatus according to the invention.

In an image forming apparatus of the present invention, images are formed by use of a photosensitive toner. As shown in FIG. 1, the image forming apparatus of this example comprises an electrically-conductive drum 2 which rotates in the direction of arrow A. The conductive drum 2 is grounded. At the upper side of the conductive drum 2 is located a toner storage unit 1 containing the photosensitive toner and a magnetic carrier, the conductive drum 2 and the toner storage unit 1 facing each other. The toner storage unit 1 comprises a housing 17 having an opening 17*a* located toward the conductive drum 2. In the housing 17 are disposed a toner feed system 1*a* and a toner collecting system 1*b* positioned upstream in the rotation of the conductive drum 2 with respect to the toner feed system 1*a*. The toner feed system 1*a* feeds the photosensitive toner from the housing 17 onto the conductive drum 2. Between the toner feed system 1*a* and the toner collecting system 1*b* is disposed a partition plate 13.

The toner feed system 1*a* has an electrically-conductive sleeve 11 and a stirring paddle 12 within the housing 17. Part of the conductive sleeve 11 protrudes from the opening 17*a* of the housing 17 so as to face the conductive drum 2. The stirring paddle 12 stirs the photosensitive toner and the magnetic carrier contained in the housing 17 so that the photosensitive toner is mixed with the magnetic carrier to be electrically charged in a prescribed polarity, for example, negatively charged, through friction therebetween.

The conductive sleeve 11 contains a magnet (not shown) therein. A bias voltage of −100 V to −1000 V, which is of the same polarity as that of the electrical charge of the photosensitive toner, is applied to the conductive sleeve 11 by a power source 16. As the conductive sleeve 11 rotates, the photosensitive toner and the magnetic carrier are fed onto the surface of the conductive sleeve 11 to form a magnetic brush thereon. As the conductive sleeve 11 further rotates, the magnetic brush formed thereon comes into contact with the conductive drum 2. As a result, the photosensitive toner of the magnetic brush is moved onto the surface of the conductive drum 2, so that a thin layer 21 of the negatively-charged photosensitive toner is formed thereon.

The toner collecting system 1*b*, which is located in the upstream part (viewed from the direction of the rotation of the conductive drum 2) of the housing 17, has a blade 14 and a transporting paddle 15 both mounted in the housing 17 and positioned below the partition plate 13. The blade 14 partly protrudes from the opening 17*a* of the housing 17 and is kept in contact with the conductive drum 2. The transporting paddle 15 is located near the blade 14. As the conductive drum 2 rotates, the blade 14 slides along the surface of the conductive drum 2 to remove photosensitive toner remaining thereon, allowing the toner to fall down into the housing 17. The transporting paddle 15 delivers the thus collected photosensitive toner back into the toner feed system 1*a* positioned above the partition plate 13.

A semiconductor laser unit 22 is disposed downstream in the rotation of the conductive drum 2 with respect to the toner storage unit 1, the laser unit 22 and the toner storage unit 1 being appropriately spaced apart from each other. The semiconductor laser unit 22 faces the conductive drum 2 and functions as an exposure means. The semiconductor laser unit 22 selectively illuminates the photosensitive toner layer 21 on the conductive drum 2, so that some portions of the toner layer 21 receive light and other portions do not receive light. The negatively-charged photosensitive toner on the portions of the toner layer 21 which have received the light becomes conductive and its electrical charge goes outside through the conductive drum 2 which is grounded. On the other hand, the photosensitive toner on the other portions which have not received light remains negatively charged. As a result, an electrostatic latent image 23 consisting of the thus electrically discharged toner and the charged toner is obtained in the toner layer 21 on the conductive drum 2.

The latent image 23 thus formed is then carried by the rotation of the conductive drum 2 to a position facing a transfer roller 24, which is disposed downstream in the rotation of the conductive drum 2 with respect to the semiconductor laser unit 22, the transfer roller 24 and the semiconductor laser unit 22 being appropriately spaced apart from each other. The transfer roller 24, which functions as a transfer means, is located facing the conductive drum 2 in such a manner that it can move toward, and away from, the conductive drum 2. To the transfer roller 24 is applied a negative bias voltage, which is of the same polarity as that of the electrical charge of the photosensitive toner.

A copy sheet 25 is passed between the transfer roller 24 and the conductive drum 2. At this time, copy sheet 25 is guided by the upper and lower guide plates 26 to be supplied into the space between the conductive drum 2 and the transfer roller 24. For this purpose, the guide plates 26 bring the front end of the copy sheet 25 into contact with the transfer roller 24 positioned away from the conductive drum 2. The front end of the copy sheet 25 is then guided by the rotating transfer roller 24 to move into the space between the conductive drum 2 and the transfer roller 24. Thereafter, the transfer roller 24 moves toward the conductive drum 2 so that the transfer sheet 25 is pressed against the latent image 23 of the photosensitive toner layer 21 on the conductive drum 2. In this way, since the front end of the copy sheet 25 is first directed to the transfer roller 24 located away from the conductive drum 2, the front end of the copy sheet 25 is prevented from being stained with the toner. When the transfer roller 24 is pressed against the conductive drum 2 with the copy sheet 25 sandwiched therebetween, only the electrically-discharged toner of the latent image 23 is attracted to the copy sheet 25 because of the bias voltage applied to the transfer roller 24. As a result, a final toner image is formed on the copy sheet 25.

Slightly apart from the transfer roller 24 in the transporting direction of the copy sheet 25 is disposed a guide plate 27 for directing the copy sheet 25 away from the conductive drum 2. The end of the guide plate 27 located toward the transfer roller 24 is provided with an insulating film 28 for pushing the copy sheet 25 upward, i.e., toward the conductive drum 2. Thus, the copy sheet 25 is pushed upward along the conductive drum 2 before it is separated therefrom.

A fixing unit 3 is located away from the guide plate 27 in the direction of the copy sheet transportation. The fixing unit 3 has a heat roller 31 and a pressure roller 32, between which the copy sheet 25 having the final toner image formed thereon is supplied, so that the toner image is fixed onto the copy sheet 25.

In the above-mentioned transfer process, the photosensitive toner which has not been irradiated with the laser light and remains electrically charged is not transferred onto the copy sheet 25 and is left on the conductive drum 2. As the conductive drum 2 further rotates, the remaining photosensitive toner 29 on the conductive drum 2 is conveyed to the position facing the toner storage unit 1, where the remaining toner 29 is removed by the blade 14 of the toner collecting system 1*b* as described above. The thus removed toner falls down into the housing 17, and is then transported by the transporting paddle 15 back into the toner feed system 1*a* located above the partition plate 13. Thereafter, the thus collected toner is stirred again together with the magnetic carrier by the stirring paddle 12 to be electrically charged through friction. Then, the collected photosensitive toner is reused to form a new thin toner layer on the conductive drum 2.

As the photosensitive toner, known powder made from a composition having an electrically-insulating resin fixing medium and a photosensitive pigment dispersed therein is used in the image forming apparatus of the invention. Examples of photoconductive pigment include zinc oxide, CdS, and other inorganic photoconductors, and perylene pigments, quinacridone pigments, pyranthrone pigments, phthalocyanine pigments, diazo pigments, triazo pigments, and other photoconductive organic pigments It is preferable that 3 to 600 parts by weight of the photoconductive pigments, and more preferably 5 to 500 parts by weight thereof, are contained in every 100 parts by weight of the resin fixing medium.

As the resin fixing medium, known electrically-insulating fixing resins such as polystyrene, styrene-acrylic copolymer, acrylic resin, polycarbonate, polyarylate and polyester; and photoconductive resins such as polyvinyl-carbazole can be used.

These respective resins can be used alone or in combination therewith.

For the purpose of making the toner sensitive to a monochrome light with a predetermined wavelength, known dye sensitizers or chemical sensitizers may be added thereto.

Furthermore, known assistants can also be added to the above essential components of the photosensitive toner in accordance with known prescriptions. Examples of the assistants include pressure-fixing additives, offset inhibitors such as wax, etc.

The median of the distribution of the toner particle diameters based on the volume thereof is preferably in the range of 6 to 12 μm, and more preferably in the range of 8 to 10 μm. The standard deviation ($\sigma$) of the distribution of the toner particle diameters based on the volume thereof is preferably 3.33 μm or less, and more preferably 2.24 μm or less. With the median of the toner particle diameters within the above preferable range, it is possible to form a uniform thin layer of toner on the conductive drum, and also possible to completely remove the remaining toner therefrom. If the median of the toner particle diameters exceeds the above range, the toner layer to be formed on the conductive drum tends to be uneven in thickness. If the median of the toner particle diameters is reduced to the level below the above range, the flowability of the toner deteriorates and the blocking of the toner tends to arise in the toner storage unit. Also, if the standard deviation of the distribution of the toner particle diameters exceeds the above preferable value, the toner will not be smoothly transferred onto the copy sheet and the remaining toner will not be sufficiently removed from the conductive drum.

The toner layer to be formed on the conductive drum should be 6 to 30 μm, and preferably 10 to 25 μm. When using a photosensitive toner having particle diameters within the above preferable range, the number of the toner particles along the thickness of the toner layer is preferably within the range of 1.5 to 2.5.

EXAMPLE 2

Figure 2:
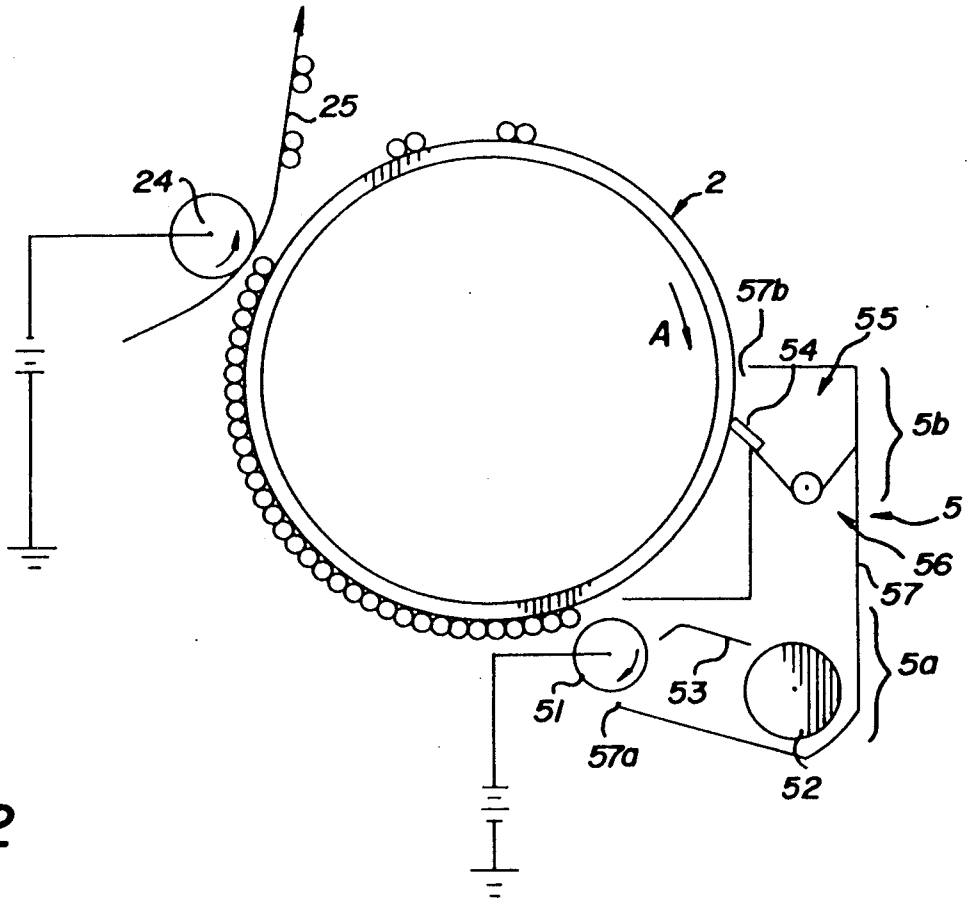
FIG. 2 is a schematic diagram showing another image forming apparatus according to the invention.

FIG. 2 shows another image forming apparatus of the present invention, in which a toner storage unit 5 is disposed at the lower side of the electrically-conductive drum 2 that rotates in the direction of arrow A. The conductive drum 2 and the toner storage unit 5 face each other. The toner storage unit 5 comprises a housing 57 having a lower opening 57*a* located toward the conductive drum 2 and also having an upper opening 57*b* also located toward the conductive drum 2 but positioned upstream (viewed from the rotation of the conductive drum 2) of the lower opening 57*a*. The housing 57 contains a toner collecting system 5*b* in the upper part thereof, and a toner feed system 5*a* in the lower part thereof.

The toner feed system 5*a* has an electrically-conductive sleeve 51 located in the opening 57*a* and a stirring paddle 52 located within the housing 57. The stirring paddle 52 stirs the photosensitive toner and the magnetic carrier contained in the housing 57 so that the photosensitive toner is electrically sensitive toner and the magnetic carrier are conveyed along a guide plate 53 onto the conductive sleeve 51.

The conductive sleeve 51 contains a magnet (not shown) therein, in the same manner as in Example 1. As the conductive sleeve 51 rotates, the photosensitive toner and the magnetic carrier are fed onto the surface thereof to form a magnetic brush thereon. As the conductive sleeve 51 further rotates, the magnetic brush formed thereon comes into contact with the conductive drum 2. As a result, the photosensitive toner of the magnetic brush is moved onto the surface of the conductive drum 2 to form a thin toner layer thereon.

The toner collecting system 5*b*, which is located in the upper part of the housing 57, has a blade 54 located within the upper opening 57*b* and a hopper 55 isolated from the other part of the housing 57. At the bottom of the toner hopper 55 is disposed a feeder 56. The blade 54, which is constantly pressed against the conductive drum 2, removes the remaining toner from the conductive drum 2, thereby allowing the toner to fall down into the toner hopper 55. The hopper 55 temporarily stores the thus collected toner. When the amount of the collected toner in the hopper 55 reaches, for example, a predetermined level, the feeder 56 is driven to supply the collected toner back into the toner feed system 5*a*.

In the same manner as in Example 1, the photosensitive toner layer on the conductive drum 2 is selectively exposed to laser light from the semiconductor laser unit (not shown), so that the photosensitive toner of the toner layer is selectively electrically discharged, resulting in an electrostatic latent image consisting of electrically charged and discharged toners. The latent image is then transported to the position facing the transfer roller 24, where the copy sheet 25 is supplied so that the electrically discharged toner of the latent image is transferred thereto, thereby forming a final image on the copy sheet 25. Thereafter, the charged toner remaining on the conductive drum 2 is removed by the blade 54 of the toner collecting system 5*b* as described above.

In this example, since the toner removed by the blade 54 from the conductive drum 2 is temporarily stored in the hopper 55, the removed toner is not immediately used again to form a new toner layer on the conductive drum 2. Thus, toner which is not sufficiently charged can be prevented from being fed onto the conductive drum 2. Furthermore, the toner which has been electrically charged by means of the stirring paddle 52 regains its photosensitive property before being fed onto the conductive drum 2.

Furthermore, since the toner collecting system 5*b* is located above the toner feed system 5*a*, the magnetic carrier within the toner feed system 5*a* does not flow into the toner collecting system 5*b*. This eliminates the possibility that the carrier will be delivered onto the conductive drum 2 through the toner collecting system 5*b* to damage the conductive drum 2.

Figure 3:
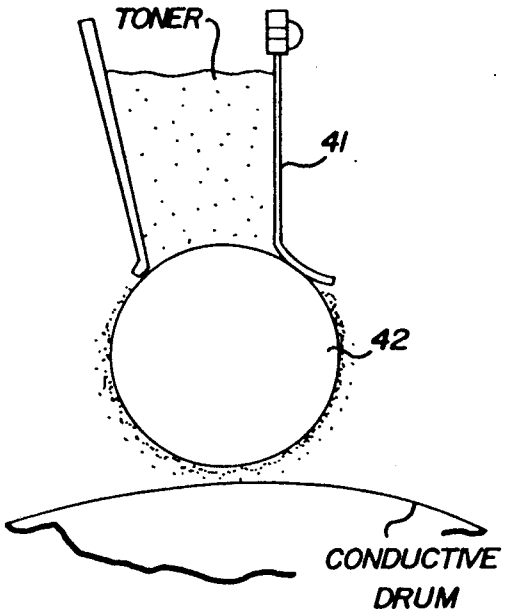
FIG. 3 is a sectional view showing a modified toner feed system.

In Examples 1 and 2, a photosensitive toner and a magnetic carrier are used as a developer, but a non-magnetic photosensitive toner alone can also be used. In the latter case, the photosensitive toner is electrically charged through friction by the use of an elastic metal blade 41 pressed against a conductive sleeve 42 as shown in FIG. 3

It is understood that various other modifications will be apparent to and can be readily made by those skilled in the art without departing from the scope and spirit of this invention. Accordingly, it is not intended that the scope of the claims appended hereto be limited to the description as set forth herein, but rather that the claims be construed as encompassing all the features of patentable novelty that reside in the present invention, including all features that would be treated as equivalents thereof by those skilled in the art to which this invention pertains.

What is clammed is:

1. An image forming apparatus comprising:

an electrically-conductive drum which rotates in a predetermined direction;

a toner storage means facing said electrically-conductive drum and having a housing which contains a photosensitive toner electrically charged in a prescribed polarity, said toner storage means including a toner feed system mounted in said housing for feeding said photosensitive toner onto said rotating electrically-conductive drum, thereby forming a thin toner layer thereon;

an exposure means located downstream in the rotation of said electrically-conductive drum with respect to said toner storage means, said exposure means selectively illuminating said thin toner layer so as to selectively electrically discharge said photosensitive toner of said thin toner layer, thereby forming an electrostatic latent image in said thin toner layer; and a transfer means located downstream in the rotation of said electrically-conductive drum with respect to said exposure means, said transfer means selectively transferring the photosensitive toner of said electrostatic latent image onto a copy sheet, thereby forming a final image thereon;

wherein said toner storage means further includes a toner collecting system mounted in said housing and positioned upstream in the rotation of said electrically-conductive drum with respect to said toner feed system, said toner collecting system removing the photosensitive toner remaining on said electrically-conductive drum after the formation of said toner image, so as to collect the removed photosensitive toner into said housing, and thereafter delivering the collected photosensitive toner into said toner feed system.

2. An apparatus according to claim 1, wherein said toner collecting system comprises a blade which slides along said electrically-conductive drum to remove said photosensitive toner remaining thereon after the formation of said toner image, thereby collecting the photosensitive toner into said housing, said toner collecting system also comprising a transporting paddle for delivering the thus collected photosensitive toner into said toner feed system.

3. An apparatus according to claim 1, wherein said toner collecting system comprises a blade which slides along said electrically-conductive drum to remove said photosensitive toner remaining thereon after the formation of said toner image, said toner collecting system also comprising a hopper for storing said photosensitive toner removed by said blade, and a feeder for supplying said photosensitive toner stored in said hopper into said toner feed system.

4. An apparatus according to claim 1, wherein said photosensitive toner is mixed with a magnetic carrier to be electrically charged through friction therebetween.

5. An apparatus according to claim 1, wherein said toner feed system includes an electrically-conductive sleeve, part of which protrudes from said housing to face said electrically-conductive drum, said electrically-conductive sleeve containing a magnet therein to enable the formation of a magnetic brush on the circumferential surface thereof, said toner feed system also including a stirring paddle for feeding said photosensitive toner contained in said housing onto said electrically-conductive sleeve.

6. An apparatus according to claim 1, wherein said toner feed system includes an electrically-conductive sleeve which rotates to carry said photosensitive toner on the circumferential surface thereof, and a metal blade which slides along said electrically-conductive sleeve to rub against said photosensitive toner carried thereon, thereby electrically charging said photosensitive toner.

* * * * *